US005513625A

United States Patent [19]

Landman

[11] Patent Number: 5,513,625

[45] Date of Patent: May 7, 1996

[54] ASH CATCHER GRATE

[76] Inventor: George R. Landman, 9514 Val Verde St., Houston, Tex. 77063

[21] Appl. No.: 378,670

[22] Filed: Jan. 26, 1995

[51] Int. Cl.[6] ..... F23H 13/00

[52] U.S. Cl. ..... 126/152 R; 126/152 B; 126/243; 126/554; 126/555

[58] Field of Search ..... 126/152 R, 152 B, 126/242, 245, 243, 554, 555

[56] References Cited

U.S. PATENT DOCUMENTS

| | | | |
|---|---|---|---|
| 1,585,449 | 5/1926 | Welsh | 126/152 RX |
| 2,292,377 | 8/1942 | Howard | 126/152 RX |
| 5,010,874 | 4/1991 | Toth | 126/243 X |
| 5,067,476 | 11/1991 | Rhodes, Jr. | 126/152 BX |
| 5,295,474 | 3/1994 | Whitfield et al. | 126/152 R |

*Primary Examiner*—Larry Jones
*Attorney, Agent, or Firm*—Matthews & Associates

[57] ABSTRACT

An improved fireplace grate which controls the scattering of ashes from fire logs is disclosed. A shroud is attached to the outer edges of a fireplace grate so that ashes from burning logs are deflected inward toward the grate instead of outward onto the floor of the fireplace. A removable tray beneath the grate is provided to collect the ashes and allow the ashes to be disposed of by simply removing and emptying the tray.

5 Claims, 1 Drawing Sheet

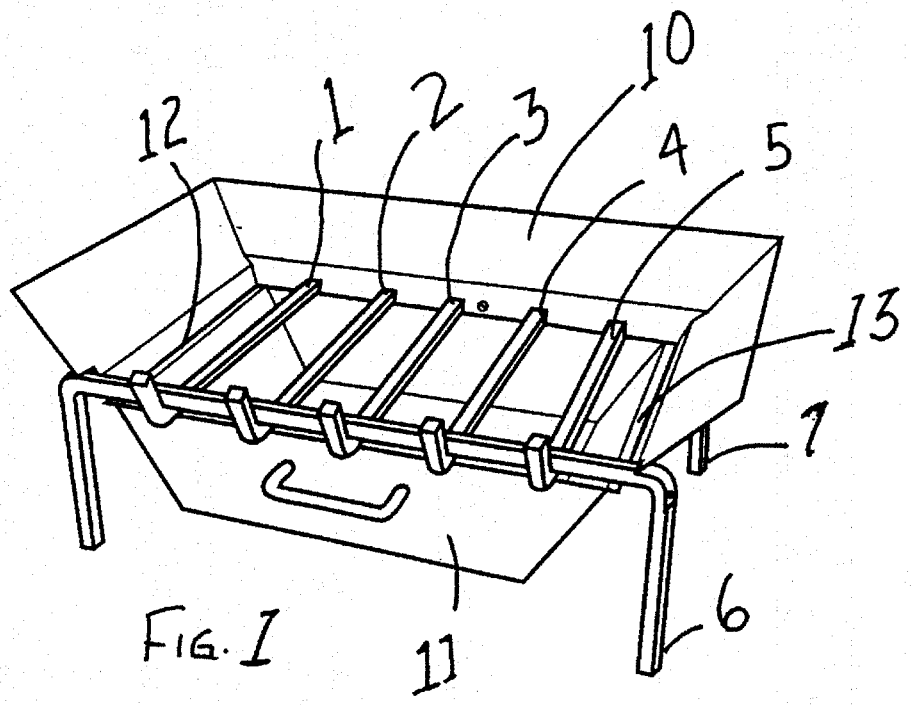
FIG. 1
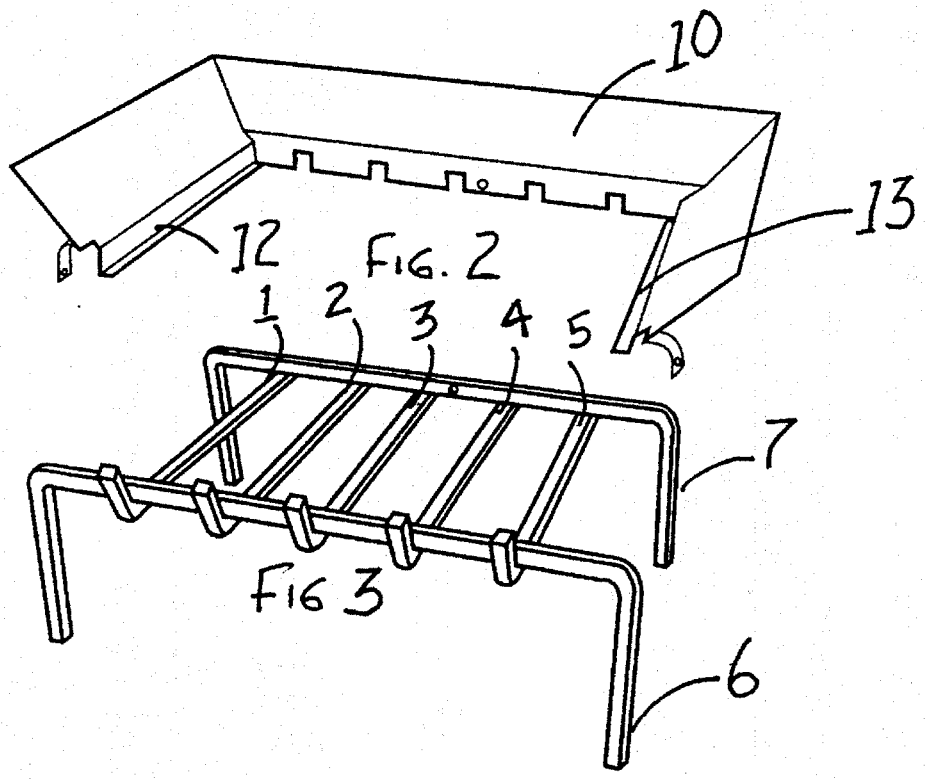
FIG. 2
FIG 3

ASH CATCHER GRATE

FIELD OF THE INVENTION

This invention relates generally to wood burning fireplaces and, more specifically, to fireplace grates for burning wood logs or pressed paper type manufactured logs.

BACKGROUND OF THE INVENTION

It has long been known in this art to use fireplace grates, typically comprising a number of metal bars shaped and welded together to form a rack to hold one or more logs off of the floor of a fireplace. These grates serve to elevate the logs above the floor of the fireplace for better burning and keep the logs from rolling out of the fireplace.

Conventional fireplace grates, however, allow the ashes from the logs to simply fall to the floor of the fireplace, which must later be cleaned. Removal of the ashes from the fireplace is a very messy, time consuming and inconvenient process.

Because of the inconvenience of having to clean up after using a conventional fireplace grate, many people are reluctant to use their fireplaces. This is particularly true of apartment dwellers, many of whom do not have the tools to clean the fireplace or simply do not wish to expend the time and effort. The importance of convenience to these people is made more evident by the popularity of manufactured, paper type fire logs, which are easier and cleaner to handle, burn and clean up the wood logs.

SUMMARY OF THE INVENTION

Because of the overriding importance of convenience to the numerous apartment dwellers and others who use manufactured fire logs and simply prefer to have a small fire, the ash catcher grate was developed. This invention increases the convenience of using a fireplace by greatly reducing the effort necessary to clean up the ashes from a fire. The invention achieves this purpose by using a shroud to deflect the ashes inward from the outer edges of the grate and to catch the ashes in a tray beneath the grate and hold them until the tray can be emptied. The invention can be made in any desired size and can be used with wood logs as well as manufactured logs.

BRIEF DESCRIPTION OF THE DRAWINGS

FIG. 1 is a perspective view of the preferred embodiment of the invention.

FIG. 2 is a perspective view of the shroud of the preferred embodiment of the invention.

FIG. 3 is a perspective view of the log supporting structure of the preferred embodiment of the invention.

DETAILED DESCRIPTION OF THE PREFERRED EMBODIMENT

Referring to FIG. 1, the preferred embodiment of the invention is based upon a conventional fireplace grate which has several metal bars, or log supporting members, 1–5 which form a generally horizontal platform upon which logs can rest. The log supporting members are oriented to run from the front to the back of the fireplace. These log supporting members are generally evenly spaced, parallel to each other and curved upward at their ends to prevent logs from rolling off the members. The grate further has two transverse members 6, 7 which join the log supporting members to maintain the position of the supporting members. The transverse members also extend downward to form the legs of the grate.

The invention further comprises a shroud 10 which is attached to the grate near the outer edges of the log supporting platform. The shroud is inclined so that ashes which fall on the shroud are deflected inward toward the center of the grate. The invention also includes a tray 11 which is held beneath the log supporting members so that ashes falling through the log supporting members are collected into the tray. The tray is removable from beneath the upper members so that the ashes may be disposed of without having to remove the entire grate from the fireplace. After the tray is emptied, it is placed back in its original position beneath the log supporting members.

In the preferred embodiment of the invention, the tray is supported at its side edges by a pair of rails 12, 13. These rails are formed integrally with the shroud as shown in FIG. 2 by extending the bottom side edges of the shroud downward and then bending them inward at about a 90 degree angle. It is not necessary that the rails be formed from the shroud, nor is it necessary that there even be rails, so long as there is some means to support the tray 11. The manner of supporting the tray is considered to be a matter of design choice and many such means will be obvious to one of ordinary skill in the art.

The structure formed by the log supporting members and the transverse members may be replaced with a log supporting platform of unitary design or with any conventional log supporting structure used in a fireplace grate. There may be more or fewer upper members or joining members and any improvements which can be incorporated into a conventional fireplace grate, such as using tubular members to generate a flow of heated air, may likewise be incorporated into the present invention. While the preferred embodiment of the invention is sized to accommodate a single paper type fire log, the invention also contemplates sizes sufficiently large to accommodate several logs and be used in a full size fireplace.

What is claimed is:

1. An improved ash catching grate for burning logs in a fireplace comprising: a platform for holding one or more fire logs; an elevating structure attached to said platform and supporting said platform in raised relation to the floor of said fireplace; a non-log-supporting shroud rigidly attached to said platform and extending outwardly and upwardly therefrom on three sides of said platform such that substantially all of the ashes falling on said shroud will be deflected inward towards said platforms, said shroud having a lower portion which extends downwardly below said platform and forms a tray-supporting structure; and a tray disposed beneath said platform and supported by said tray-supporting structure such that ashes falling through said platform will fall downward into said tray.

2. The improved ash catching grate of claim 1, wherein said elevating structure comprises a plurality of leg members which are substantially rigidly attached to said platform and which extend downwardly from said platform.

3. The ash catching fireplace grate of claim 2 wherein said platform is oriented substantially horizontally and has a front edge, a back edge, and two opposed side edges, and wherein said shroud has a lower edge which is disposed near the back edge and side edges of said platform.

4. The ash catching fireplace grate of claim 2 wherein said tray is removably attached to said tray-supporting structure.

5. The ash catching fireplace grate of claim 4 wherein said tray is slidably connected to said tray-supporting structure.

* * * * *